United States Patent [19]

Whitaker

[11] 3,975,784

[45] Aug. 24, 1976

[54] MARINE STRUCTURE

[75] Inventor: Charles T. Whitaker, Balwyn, Australia

[73] Assignee: Marine Consultants Pty., Ltd., South Melbourne, Australia

[22] Filed: Aug. 7, 1974

[21] Appl. No.: 495,535

[30] Foreign Application Priority Data

Aug. 9, 1973 Australia ..... 4419/73

[52] U.S. Cl. ..... 9/8 R; 37/54; 61/72.4; 114/0.5 R; 114/230; 115/1 R; 137/236

[51] Int. Cl.[2] ..... B63B 21/52

[58] Field of Search ..... 9/8 R, 8 P, 8.5; 114/0.5 R, 0.5 T, 74 T, 123, 16 R, 66, 230; 137/236; 210/170; 175/7; 61/72.3, 72.4, 46.5; 37/54; 115/1 R

[56] References Cited

UNITED STATES PATENTS

| | | | |
|---|---|---|---|
| 3,031,997 | 5/1962 | Nesbitt | 9/8 P |
| 3,099,912 | 8/1963 | Wolff | 114/123 |
| 3,464,466 | 9/1969 | Bryan | 114/0.5 T |
| 3,490,485 | 1/1970 | Munson | 137/236 |
| 3,566,608 | 3/1971 | Ramme | 61/46.5 |
| 3,674,687 | 7/1972 | Quase | 137/236 |
| 3,774,253 | 11/1973 | Lecomte | 9/8 P |
| 3,900,077 | 8/1975 | Gee et al. | 114/16 R |

FOREIGN PATENTS OR APPLICATIONS

| | | | |
|---|---|---|---|
| 1,231,036 | 9/1960 | France | 114/0.5 T |

*Primary Examiner*—Stephen G. Kunin
*Assistant Examiner*—Charles E. Frankfort
*Attorney, Agent, or Firm*—Diller, Brown, Ramik & Wight

[57] ABSTRACT

A marine structure having a buoyant tower flexibly connected to a base on the sea bed. The buoyant tower includes a buoyant tank which is movable in guide tracks extending lengthwise of the tower. The base may have drive tracks for moving along the sea bed so that material gathering, pipe laying or harbour construction operations on the sea bed can be carried out. For pollutants disposal the tower may receive waste, mix it with sea water and diffuse it into the sea.

14 Claims, 5 Drawing Figures

MARINE STRUCTURE

The present invention relates to marine structures for performing various functions in a body of water. More particularly the invention relates to marine towers including a buoyant tower for flexible connection to an anchoring base on the sea bed. The buoyant tower has at least one buoyant chamber or tank intermediate its length for providing at least part of the positive buoyancy of the tower. The tower may be pivotally connected at its lower end directly to the base. Alternatively the tower may be connected to the base by a flexible anchoring line such as an anchoring chain or cable.

As used throughout this specification the terms "marine" and "sea" are used to include all suitable bodies of water including fresh water environments.

Marine structures having the tower pivotally connected to the base are known. However such structures have been generally designed for use in one particular location and have not been readily adaptable for use in a different location subject to different conditions such as water depth and weather conditions.

The dumping or discharge of pollutants into the sea has in the past generally been severly detrimental to the balance of life in the area of disposal.

An object of one embodiment of the present invention is to improve the versatility and characteristics of marine structures.

An object of a further embodiment of the present invention is to enable relatively safe offshore disposal of pollutants or waste products.

According to one aspect of the present invention there is provided a marine structure having an elongated buoyant tower for flexible connection to an anchoring base on the sea bed, said buoyant tower in use adopting a substantially upright attitude above said base, said buoyant tower including; guide means extending along at least part of the length thereof, at least one buoyant chamber selectively movable along said guide means, and means for locating said chamber in a predetermined position longitudinally of the tower.

The guide means preferably comprise a plurality of guide tracks extending lengthwise externally of the tower. The locating means preferably comprises locking means, such as a plurality of clamping means, associated with the chamber for locking the chamber in the predetermined position.

According to a further aspect of the present invention there is provided a marine structure having an elongated buoyant tower for flexible connection to an anchoring base on the sea bed, said buoyant tower in use adopting a substantially upright attitude above said anchoring base, said buoyant tower including at least one buoyant chamber, and said anchoring base including drive tracks thereon for enabling the base to move along the sea bed.

Preferably the buoyant chamber is selectively movable along at least part of the length of the tower to enable the structure to operate continuously in varying depths of water.

According to a still further aspect of the present invention there is a provided a marine structure for offshore disposal of pollutants, and including: a deadweight base for resting on the sea bed; a buoyant tower flexibly connected to said base, said buoyant tower including at least one buoyant chamber and in use adopting a substantially upright attitude above said base; a pollutant receiving inlet in said tower; mixing means in said tower for receiving pollutant from said inlet and for diluting said pollutant with sea water; and pollutant emitting means for discharging the diluted pollutant into the sea.

The lower end of the tower may be provided with a skirt portion for sealing engagement with the upper portion of the base. The upper portion of the base may be rotatable to prevent kinking of lines coupling the same to the tower.

The aspects of the present invention will now be described with reference to the accompanying drawings, which illustrate preferred embodiments only.

Figure 1:
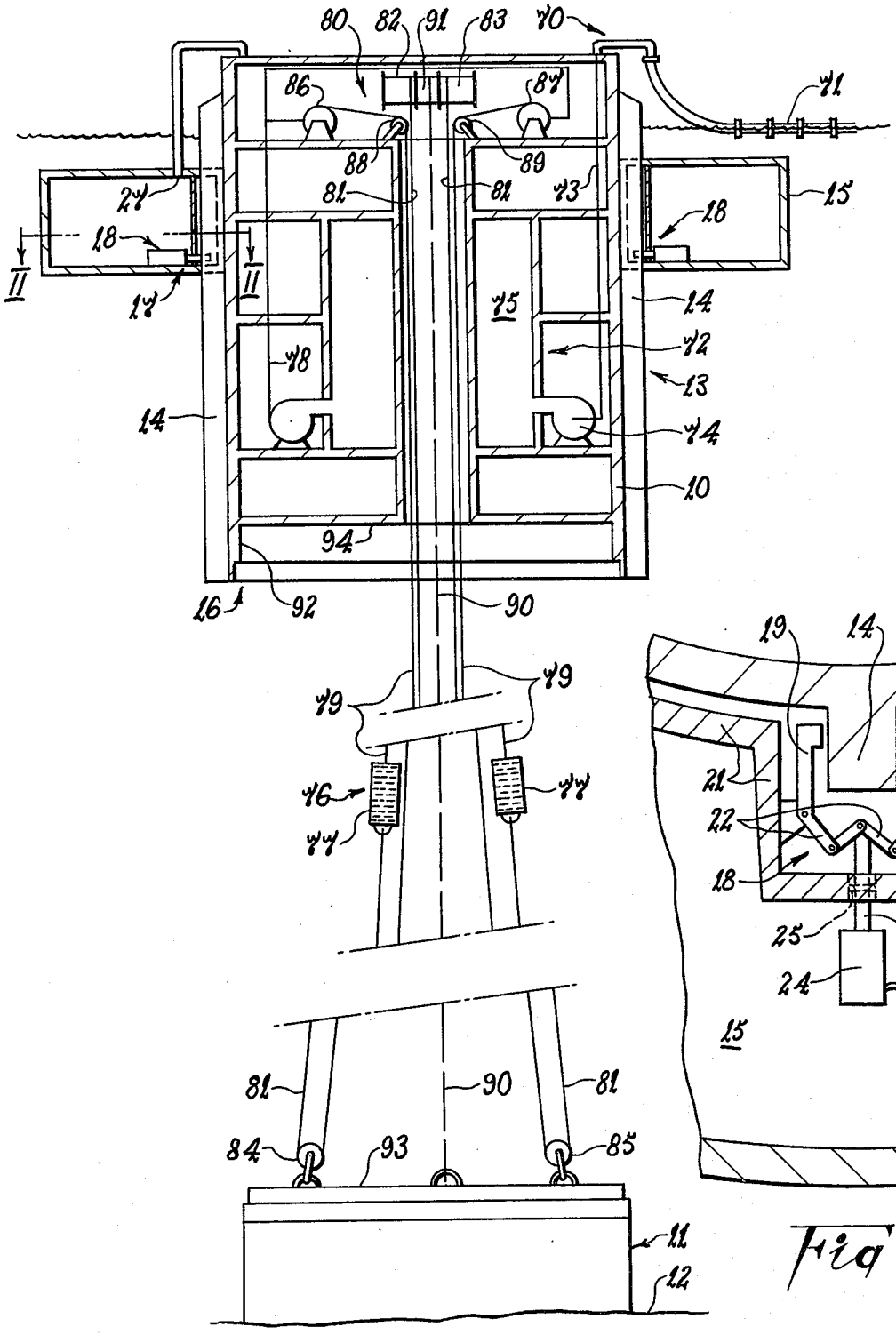
FIG. 1 is a sectional side elevational view of a marine structure embodying the first and third aspects of the invention.

The marine structure illustrated in FIG. 1 has an elongated buoyant tower 10 flexibly connected to anchoring base 11 on the sea bed 12. As shown the tower 10 in use adopts a substantially upright attitude above the base 11. According to the first aspect of the invention the tower 10 includes guide means 13 extending along at least part of the length thereof. The guide means 13 comprise a plurality of guide tracks 14 extending lengthwise externally of the tower 10.

The structure also includes a buoyant chamber 15 selectively movable along the guide means 13. The chamber 15 is illustrated as a single buoyant tank surrounding the tower 10 although a plurality of chambers 15 may be provided if desired. The guide tracks 14 extend to the lower end 16 of the tower 10 so that the chamber 15 can be lowered down the length of the tower 10 and off the lower end 16 for maintenance or other purposes.

Figure 2:
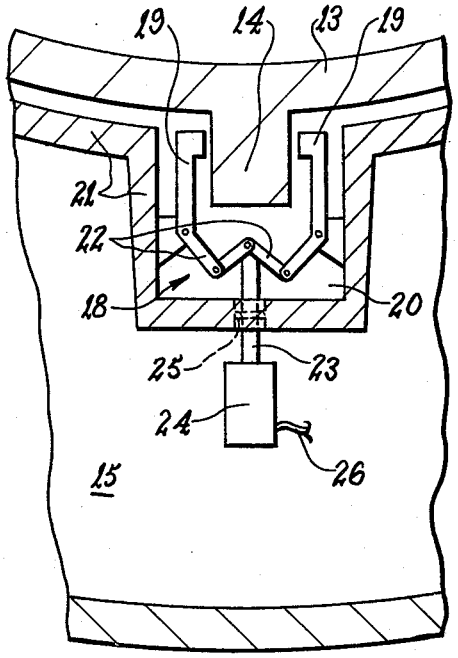
FIG. 2 is a sectional view taken along the line II—II in FIG. 1.

The structure also includes means 17 for locating the chamber 15 in a predetermined position longitudinally of the tower 10. The locating means 17 comprises locking means 18 associated with the chamber 15 for locking the chamber 15 in the predetermined position. The locking means 18 comprises a plurality of clamping means 19 for clamping to the guide tracks 14. As shown in FIG. 2 the clamping means 19 are located inside a channel 20 formed in the inner wall 21 of the chamber 15. The clamping means 19 are pivoted to the walls defining the channel 20 and are pivotally coupled via links 22 to plunger 23 of hydraulic cylinder 24. The hydraulic cylinder 24 is located inside chamber 15 and plunger 23 passes through sealing ring 25 in the wall 21. Fluid supply line 26 to hydraulic cylinder 24 passes out of chamber 15 and into the tower 10 to hydraulic drive means (not shown) located in the tower 10. The clamping means 19 are shown in their released condition. It will be seen that if plunger 23 is retracted into cylinder 24 the clamping means will pivot about their centres and thus clamp guide track 14.

The chamber 15 is provided with an inlet 27 for receiving ballast material, such as sea water, to nullify the positive buoyancy of the chamber 15. By thus providing a variable buoyancy chamber 15 no positive drive to the chamber 15 is necessary. For example the chamber 15 can be lowered on the tower 10 by ballasting the chamber 15 with water, releasing the clamping means 19 and allowing the chamber 15 to slide down on the guide tracks 14. When the chamber 15 reaches its predetermined position the clamping means 14 are actuated to lock the chamber 15 in that position. The ballast water can then be pumped out of the chamber 15 through an outlet (not shown) by introducing compressed air through the inlet 27. To raise the chamber 15 the clamping means 19 may be released thus allowing the chamber 15 to rise up the tower 10 by virtue of its positive buoyancy.

This movable buoyant chamber 15 enables simple variation of the rigidity of the tower 10 and also enables one tower to be used in different depths of water and varying weather conditions.

Figure 3:
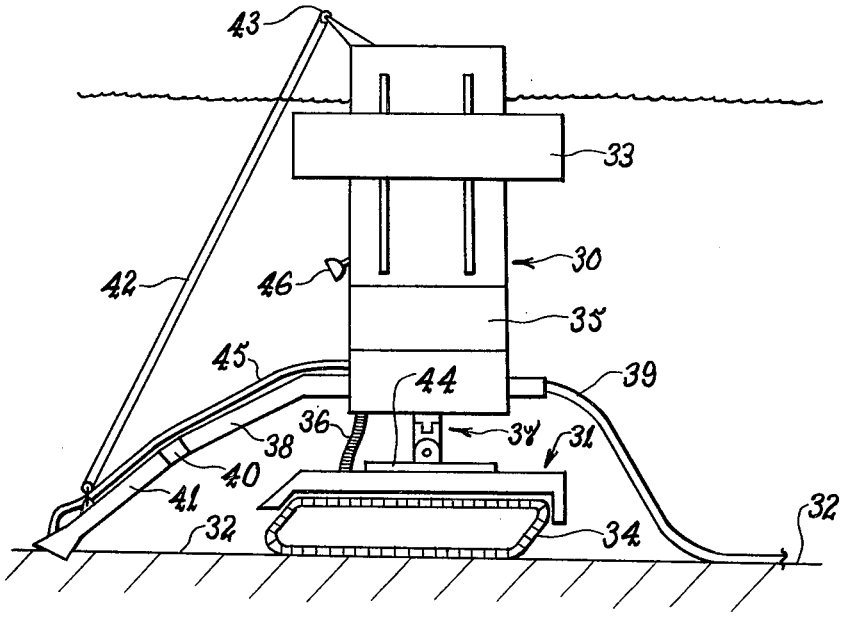
FIG. 3 is a side elevational view of a structure according to the second aspect of the invention.

The marine structure illustrated in FIG. 3 has an elongated buoyant tower 30 flexibly connected via universal joint 37 to anchoring base 31 on the sea bed 32. As shown the tower 30 adopts a substantially upright attitude above the base 31. The buoyant tower 30 includes a buoyant chamber 33. The anchoring base 31 includes drive tracks 34 thereon for enabling the base 31 to move along the sea bed 32. The drive tracks 34 are of the general type used in military tanks, bulldozers etc. The speed and direction of the movement of the base 31 is controlled from a control room 35 inside tower 30. The drive may be hydraulic. For example a hydraulic pump (not shown) may be located in the tower 30 for transmitting drive fluid through flexible hose 36 to hydraulic motor(s) (not shown) located inside the base 31, the hydraulic motor(s) being drivingly coupled to the drive tracks 34.

The chamber 33 in FIG. 3 is selectively movable along at least part of the length of the tower 30 as described above in relation to FIGS. 1 and 2. This enables the structure to operate in different depths of water and in varying weather conditions.

The FIG. 3 embodiment is usable for land reclamation, navigation channel dredging or offshore gravel and sand mining. The structure includes a suction pipe 38 coupled to the tower 30 for gathering granular material from the sea bed 32 in a slurry. The structure also includes a transfer pipe 39 for conveying the slurry away from the tower 30. The suction pipe 38 may have a universal jointed section 40 therein for enabling control of the collection end 41 of the pipe 38. The vertical control of end 41 may be effected by means of pulley line 42 extending to the pulley davit 43 on top of the tower 10. The lateral control of the pipe 38 may be effected by providing a turntable 44 on top of base 31 to which tower 10 is connected and about which the tower 10 can rotate. A water jet line 45 may be provided from the tower 10 to the collection end 41 through which water is pumped to assist in breading up and collecting material in a slurry. All control may be exercised from control room 35. Flood lights 46 may be provided for assisting direct visual or closed circuit television monitoring of the operation. The transfer pipe 39 may extend to shore inland reclamation, or to a barge or tanker in mining.

Figure 4:
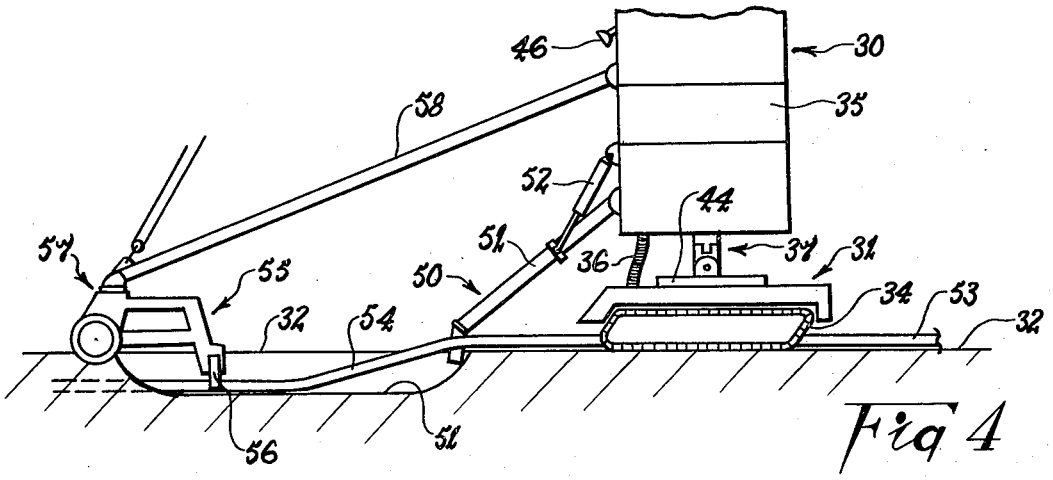
FIGS. 4 and 5 are side elevational views similar to FIG. 3 but showing different possible uses of the structure.

FIG. 4 illustrates a pipe laying structure in which similar components to those described in relation to FIG. 3 are indicated by the same reference numerals. The structure in FIG. 4 includes trench forming means 50 for forming a trench 51 behind the base 31. The trench forming means 50 is shown as a suction pipe 51 which is adjustable vertically by hydraulic means 52. A pipe 53 is laid on the sea bed 32 along the approximate line of laying. The drive tracks 34 of the base 31 straddle and move along the direction of the pipe 53. As the trench 51 is formed the pipe 53 relaxes into the trench 51 as shown at 54.

The trench forming means 50 is followed by pipe guide means 55 for laterally positioning the pipe 53 within the trench. The pipe guide means 55 includes a roller 56 located on each side of the pipe 53 which is laterally movable, e.g. hydraulically, to guide the pipe 53 around any obstacles in the trench 51.

The pipe guide means 55 is followed by trench filling means 57 for filling in the trench 51 with the pipe 53 laid therein. The trench filling means 57 receives the material excavated by the trench forming means 50 from the tower 30 through return pipe 58.

Figure 5:
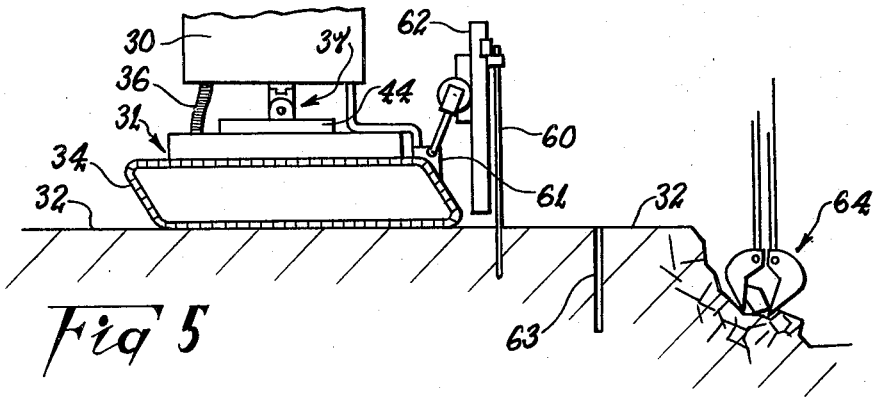

FIG. 5 shows a structure for drilling and blasting for pipe laying and/or harbour construction. The structure includes at least one rock drill 60 mounted on the rear end 61 of the base 31. The rock drill 60 is mounted on drill support 62 which in turn is adjustably mounted to base 31. All control of the drill 60 is effected from within the tower 30. Explosive charges may be placed in holes 63 either remotely or by "frogmen". A crane (not shown) may be provided on top of the tower 30 for collecting rubble as at 64.

In the embodiment illustrated in FIG. 1 the tower 10 includes a pollutant receiving inlet 70. The pollutant material is in a liquid or slurry form and is received through floating line 71 from a tanker (not shown) or may be received through a line running from shore along the sea bed 12.

The tower 10 includes mixing means 72 for receiving pollutant from the inlet 70 and for diluting the pollutant with sea water. The pollutant from inlet 70 passes through line 73 to pump 74. The pump 74 pumps pollutant into mixing chamber 75 into which is also introduced sea water in controlled amounts either by a further pump (not shown) or by a venturi effect. The pollutant in chamber 75 is thoroughly mixed with the sea water until a suitable specific gravity (e.g. 1.1) is reached to enable effective dispersal in the sea.

The structure includes pollutant emitting means 76 for discharging the diluted pollutant into the sea. The pollutant emitting means 76 comprise two diffusers 77 suspended between the tower 10 and the base 11. The diffusers 77 receive the diluted pollutant from the mixing means 72 via line 78 and output lines 79. The diffusers 77 may be, for example, suspended at a depth of 250 metres in a total depth of 1000 metres. The tower 10 includes adjusting means 80 for enabling adjustment of the depth of the diffusers 77. the adjusting means 80 includes adjusting lines 81 which extend from adjusting winches 82, 83 to pulley blocks 84, 85 mounted on the base 11 and thence to the diffusers 77. The output lines 79 are flexible hoses which extend from hose reels 86, 87 over sheaves 88, 89, through the tower 10 to diffusers 77. Thus to lower, for example, the diffusers 77 the adjusting lines 81 are taken up by winches 82, 83 while the hose reels 86, 87 let out more line 79 to the diffusers 77.

The tower 10 is flexibly connected to base 11 by anchoring line 90. The anchoring line 90 is wound onto anchor winch 91. The lower end 16 of the tower 10 is provided with a skirt portion 92 for sealing engagement with the upper portion 93 of the base 11 when the base 11 is raised from the sea bed 12. The bulkhead 94 of the tower 10, skirt portion 92 and upper portion 93 of the base 11 form a storage or maintenance chamber which can be evacuated of water to enable access to the diffusers 77. The base upper portion 93 is rotatable with respect to the main body of the base 11 to prevent kinking of the anchoring line 90 and adjusting lines 81 coupling the same to the tower 10.

A slightly modified marine structure to that shown in FIG. 1 may be used for thermal pollution control, for example in the cooling of power station cooling water. A submarine cooling water line maybe passed from the power station to the structure wherein the heated water is mixed with sea water for example in a venturi mixing chamber and the cooled water then being discharged at surface level.

Finally it is to be understood that various minor alterations and modifications may be made to the foregoing without departing from the scope of the invention as defined in the appended claims.

Having now described my invention, what I claim as new and desire to secure by Letters patent is:

1. A marine structure comprising an elongated tower, means flexibly connecting said tower to an anchoring base on a sea bed, a buoyant member carried by said tower and being arranged for generally vertical movement therealong, said buoyant member totally circumferentially surrounds said tower, said buoyant member including at least one chamber, guide means longitudinal of said tower between said tower and said buoyant member for guiding relative vertical movement therebetween and restraining relative rotational movement therebetween, and means for fixedly securing said buoyant member relative to said tower at selected relative vertical positions therealong.

2. A marine structure as claimed in claim 1 wherein said securing means comprises locking means associated with said buoyant member for locking said buoyant member in said selected positions.

3. A marine structure as claimed in claim 1 wherein said guide means comprises a plurality of guide tracks extending lengthwise externally of said tower.

4. A marine structure as claimed in claim 3 wherein said securing means comprises a plurality of clamping means for clamping to said guide tracks.

5. A marine structure as claimed in claim 3 wherein said guide tracks extend to the lower end of the tower.

6. A marine structure as claimed in claim 1 wherein said chamber is provided with an inlet for receiving ballast material to nullify the positive buoyancy of said buoyant member.

7. A marine structure as defined in claim 1 wherein said anchoring base includes drive tracks thereon for enabling the base to move along the sea bed.

8. A marine structure as claimed in claim 7 and further including a suction pipe coupled to said tower for gathering granular material from said sea bed in a slurry and a transfer pipe for conveying said slurry away from said tower.

9. A marine structure as claimed in claim 7 and further including trench forming means for forming a trench behind said base, pipe guide means for laterally positioning a pipe within said trench and trench filling means following said pipe guide means for filling said trench with said pipe laid therein.

10. A marine structure as claimed in claim 7 and further including at least one rock drill mounted on the rear end of said base and operable from within said tower.

11. A marine structure as defined in claim 1 wherein a pollutant receiving inlet is provided in said tower; mixing means is provided in said tower for receiving pollutant from said inlet and for diluting said pollutant with sea water; and pollutant emitting means is provided for discharging the diluted pollutant into the sea.

12. A marine structure as claimed in claim 11 wherein the lower end of said tower is provided with a skirt portion for sealing engagement with the upper portion of said base.

13. A marine structure as claimed in claim 11 wherein said pollutant emitting means comprises at least one diffuser suspended between said tower and said base and for receiving the diluted pollutant from said mixing means through an output line and for discharging the same into the sea.

14. A marine structure as claimed in claim 13 wherein the tower includes adjusting means for enabling adjustment of the depth of said diffuser.

* * * * *